US007377264B2

(12) United States Patent
Buehner

(10) Patent No.: US 7,377,264 B2
(45) Date of Patent: May 27, 2008

(54) FUEL INJECTOR

(75) Inventor: Martin Buehner, Backnang (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/583,245

(22) PCT Filed: Nov. 2, 2004

(86) PCT No.: PCT/EP2004/052751

§ 371 (c)(1),
(2), (4) Date: May 25, 2007

(87) PCT Pub. No.: WO2005/059352

PCT Pub. Date: Jun. 30, 2005

(65) Prior Publication Data

US 2007/0251503 A1 Nov. 1, 2007

(30) Foreign Application Priority Data

Dec. 16, 2003 (DE) ..... 103 58 913

(51) Int. Cl.
*F02M 61/14* (2006.01)
*F02M 61/18* (2006.01)

(52) U.S. Cl. ..... 123/470; 123/467

(58) Field of Classification Search ..... 123/470, 123/467, 468, 469; 277/591, 595, 596, 599, 277/600; 239/533.11
See application file for complete search history.

(56) References Cited

U.S. PATENT DOCUMENTS

| | | | | |
|---|---|---|---|---|
| 5,129,658 | A | 7/1992 | Berton et al. | |
| 6,186,123 | B1 | 2/2001 | Maier et al. | |
| 6,223,727 | B1 | 5/2001 | Tahara et al. | |
| 6,481,421 | B1 * | 11/2002 | Reiter | 123/470 |
| 6,745,956 | B1 | 6/2004 | Bantle et al. | |
| 6,892,707 | B2 * | 5/2005 | Reiter et al. | 123/470 |

FOREIGN PATENT DOCUMENTS

| | | |
|---|---|---|
| DE | 101 09 407 | 9/2002 |
| DE | 102 35 445 | 2/2003 |

* cited by examiner

*Primary Examiner*—Mahmoud Gimie
(74) *Attorney, Agent, or Firm*—Kenyon & Kenyon LLP

(57) ABSTRACT

A seal for sealing the fuel injector from a valve mount opening of a cylinder head, the seal radially surrounding the region of the discharge-side end of a fuel injector, sealingly rests on the valve mount opening opening via a first section. By way of at least an axial partial section, which extends only across a portion of the axial height of the seal, the seal is fitted in the region of the discharge-side end of the fuel injector in integral fashion, by form-fit and/or force-locking.

15 Claims, 4 Drawing Sheets

Fig. 6A
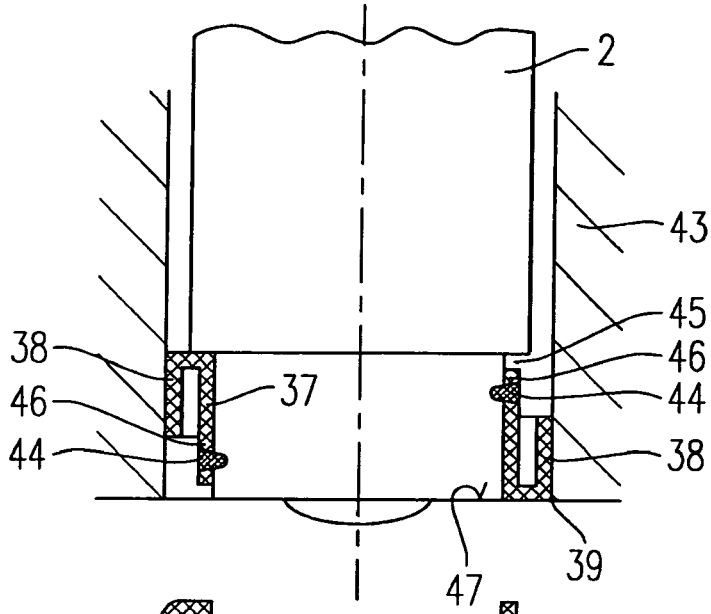
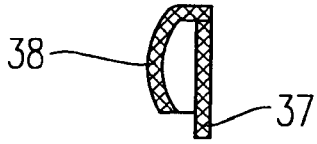
Fig. 6B
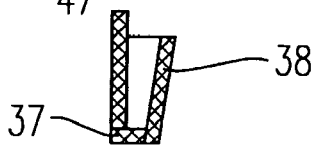
Fig. 6C
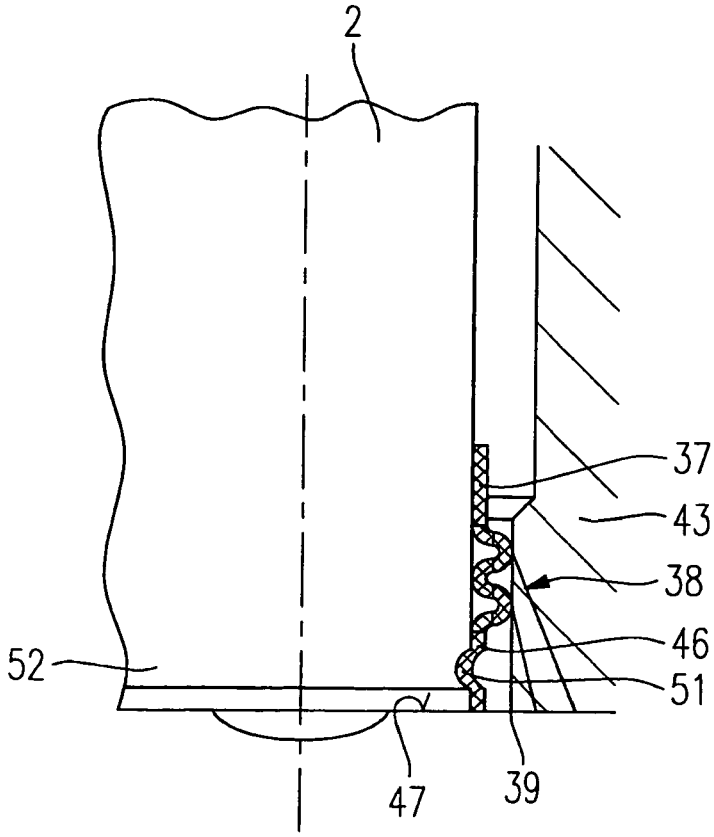
Fig. 7

FUEL INJECTOR

FIELD OF THE INVENTION

The present invention is based on a fuel injector.

BACKGROUND INFORMATION

From German Published Patent Application No. 101 09 407, for instance, a fuel injector having a seal situated on the discharge side is known. The seal, which is made of a copper-tin alloy or stainless steel, for example, is situated in an annular groove radially surrounding a nozzle body and in this way is axially fixed in place with form-locking and seals the fuel injector from a cylinder head.

A particular disadvantage of the fuel injector known from the aforementioned printed publication is that because of the completely form-fitting embedding of the seal the seal cannot be placed as close to the transition to the combustion chamber as desired. This allows gases or fuel present in the combustion chamber to penetrate the gap situated between the discharge-side end of the fuel injector and the cylinder head, and results in leakages at the seal in that, for instance, the seal is lifted off the annular groove, or uncombusted fuel deposits in the gap, which can have a detrimental effect on the exhaust gas.

SUMMARY OF THE INVENTION

In contrast, the fuel injector according to the present invention has the advantage that the seal is able to be moved up to the transition to the combustion chamber, so that the sealing effect is improved in this manner.

The seal is advantageously fitted in the discharge-side region of the fuel injector, with the aid of welding, laser-welding, tamping or pressing. In this way the joint is able to be produced according to the specifications in a cost-effective and reliable manner.

In a further development of the fuel injector according to the present invention, the seal is made of metal, especially steel or V2A steel, a copper alloy and/or a brass alloy. Depending on the requirements regarding temperature stability and temperature response, the seal is able to be designed in a correspondingly advantageous and cost-effective manner.

It is also advantageous if the seal takes the form of a sleeve or if the seal is produced by reforming, in particular deep-drawing and/or crimping. This allows the seal to be manufactured in large numbers in a very cost-effective and precise manner.

The first section is advantageously at least partially permanently elastic and is thereby prestressed with respect to the valve mount opening opening. As a result, the seal is able to be reused and may remain on the fuel injector, for instance when the fuel injector is uninstalled and the same fuel injector is later reinstalled.

Since the first section projects outwardly compared to the adjoining parts of the seal, and/or the first section has a wave-like design and thus rests against the valve mount opening opening at a plurality of points, the sealing effect of the seal is able to be improved.

The U-shaped design of the seal also allows the seal to be produced more easily.

In addition, it is advantageous to situate the bottom of the U-shaped section at the level of a step, so that the dead space located between the nozzle body and the valve mount opening opening is minimized, or at the level of the discharge-remote end of the reduced-diameter section, so that the first section is pressed against the valve mount opening opening by the gas pressure in the combustion chamber and the sealing effect is improved in the process.

In an advantageous manner the seal extends axially between the discharge-side region of the fuel injector and the valve mount opening opening to a transition area where the valve mount opening opening goes over into the combustion chamber. This also minimizes the dead space.

In a further development, the first section rests in a sealing manner at least partially on a first bearing surface, which tapers and reduces the diameter of the valve mount opening opening. This allows the sealing effect of the seal to be improved, which may also be achieved by indirectly prestressing the seal with respect to at least the first bearing surface, via other parts of the fuel injector.

BRIEF DESCRIPTION OF THE DRAWINGS

FIG. 6A shows a schematic section through a fifth and sixth exemplary embodiment of a fuel injector according to the present invention, in the discharge-side region.

FIGS. 6B and 6C show schematic representations of the seal in the uninstalled state.

FIG. 7 shows a schematic section through a seventh exemplary embodiment of a fuel injector according to the present invention, in the discharge-side region.

DESCRIPTION DESCRIPTION

Figure 1:
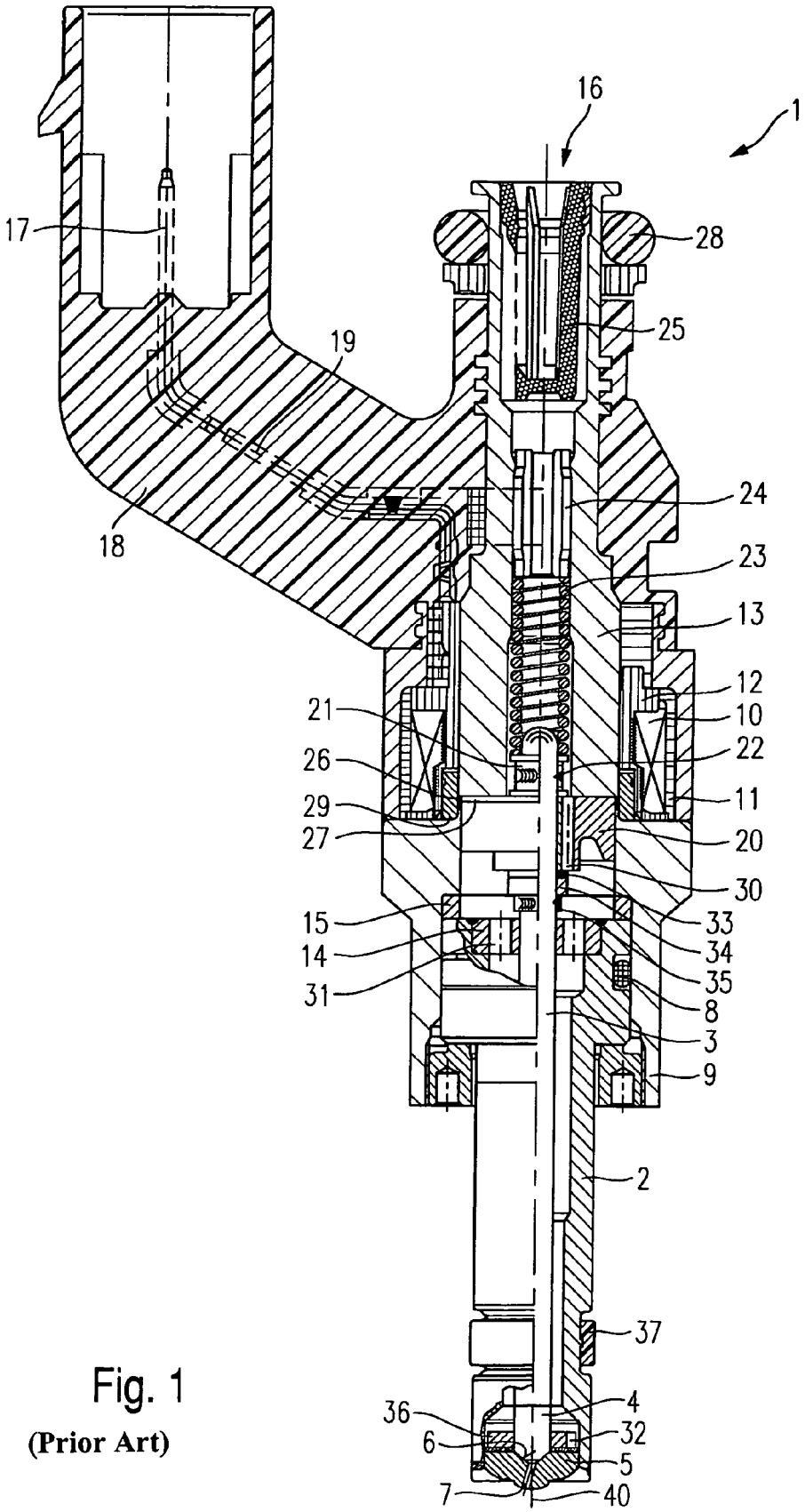
Fig. 1 (Prior Art)
FIG. 1 shows a schematic section through an exemplary embodiment of a generic fuel injector.

In the following, exemplary embodiments of the present invention are described by way of example. Identical components have been provided with matching reference numerals.

Before giving a more detailed description, based on FIGS. 2 through 9, of preferred exemplary embodiments according to the present invention, a generic fuel injector will first be explained briefly in terms of its essential components with reference to FIG. 1 so as to provide a better understanding of the present invention.

An exemplary embodiment of a fuel injector 1 according to the present invention, shown in FIG. 1, is designed in the form of a fuel injector for fuel-injection systems of mixture-compressing internal combustion engines having externally supplied ignition. Fuel injector 1 is particularly suited for the direct injection of fuel into a combustion chamber (not shown) of an internal combustion engine.

Fuel injector 1 is made up of a nozzle body 2 in which a valve needle 3 is positioned. Valve needle 3 has on its discharge side a valve-closure member 4, which cooperates with a valve-seat surface 6 disposed on a valve-seat member 5 to form a sealing seat. In the exemplary embodiment, fuel injector 1 is an inwardly opening fuel injector 1, which has a spray orifice 7. A seal 8 seals nozzle body 2 against an outer pole 9 of a solenoid coil 10. Solenoid coil 10 is encapsulated in a coil housing 11 and wound on a coil brace 12 which rests against an inner pole 13 of solenoid coil 10. Inner pole 13 and outer pole 9 are separated from one another by clearance 26 and interconnected by a non-ferromagnetic connecting part 29. Solenoid coil 10 is energized via an electric line 19 by an electric current, which may be supplied via an electrical plug contact 17. Plug contact 17 is enclosed by a plastic coat 18, which is extrudable onto inner pole 13.

Valve needle 3 is guided in a valve-needle guide 14, which is disk-shaped. A paired adjustment disk 15 is used to adjust the (valve) lift. Armature 20 is disposed on the other side of adjustment disk 15. Via a first flange 21 it is connected with valve needle 3, which is joined to first flange 21 by a welded seam 22. A helical restoring spring 23 is braced on first flange 21 and prestressed by a sleeve 24 in the present design of fuel injector 1.

Fuel channels 30, 31 and 32 run in valve-needle guide 14, armature 20 and along a guide element 36. The fuel is supplied via a central fuel supply 16 and filtered by a filter element 25. A rubber ring 28 seals fuel injector 1 from a fuel distributor line (not shown further), and a seal 37 seals it from a cylinder head 43 (not shown further).

On the spray-discharge side of armature 20 is an annular damping element 33 made of an elastomeric material. It rests on a second flange 34, which is integrally joined to valve needle 3 via a welded seam 35.

In the quiescent state of fuel injector 1, armature 20 is acted upon by restoring spring 23 against its direction of lift, in such a way that valve-closure member 4 is held in sealing contact on valve-seat surface 6. When excited, solenoid coil 10 generates a magnetic field that moves armature 20 in the lift direction, counter to the spring force of restoring spring 23, the lift being defined by a working gap 27 occurring between inner pole 12 and armature 20 in the rest position. First flange 21, which is welded to valve needle 3, is taken along by armature 20 in the lift direction as well. Valve-closure member 4, which is joined to valve needle 3, lifts off from valve seat surface 6, so that the fuel supplied under pressure is spray-discharged into the combustion chamber (not shown) through spray-discharge orifice 7.

If the coil current is interrupted, following sufficient decay of the magnetic field, armature 20 falls away from inner pole 13 due to the pressure of restoring spring 23, whereupon first flange 21, being joined to valve needle 3, moves in a direction counter to the lift direction. Valve needle 3 is thereby moved in the same direction, causing valve-closure element 4 to set down on valve seat surface 6 and fuel injector 1 to be closed.

In the illustrated exemplary embodiment, nozzle body 2, valve needle 3 and valve-seat body 5 are formed coaxially with respect to a center axis 40.

FIGS. 2 through 9 show schematic illustrations in the discharge-side region of exemplary embodiments of fuel injector 1 according to the present invention. Fuel injector 1 is situated in a valve mount opening opening 48 of a cylinder head 43.

Fuel injector 1 has a step 47 in the discharge-side region, just before the discharge-side end, the step being formed in nozzle body 2 and reducing the diameter of nozzle body 2. Seal 37 ends in the discharge direction at the level of a transition region 39 where valve mount opening 48 goes over into the combustion chamber. Step 47 is situated at the level of transition region 39.

Seal 37 is essentially sleeve-shaped, produced by reforming, in particular deep-drawing and/or crimping, and has at least one first section 38 which projects outwardly compared to the immediately adjoining parts of seal 37. First section 38 completely surrounds seal 37 and is permanently elastic, for example, it being possible to give the entire seal 37 a permanently elastic design. When installed in valve mount opening 48, first section 38 is prestressed with respect to the wall of valve mount opening 48 and seals fuel injector 1 from cylinder head 43.

Figure 2:
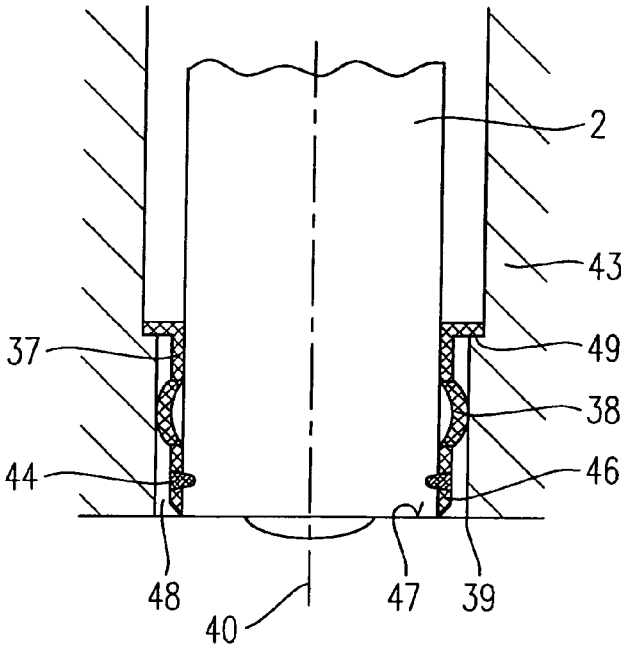
FIG. 2 shows a schematic section through a first exemplary embodiment of a fuel injector according to the present invention, in the discharge-side region.

First section 38 of seal 37 of the first exemplary embodiment, schematically illustrated in FIG. 2, is situated approximately at the mid-level of seal 37. In cross-sectional profile, first section 38 is curved outwardly in a spherical or part-circular manner.

The discharge-side end of seal 37 is beveled on the outside.

At an axial partial section 46 of seal 37, seal 37 is fitted in the region of the discharge-side end of fuel injector 1. In this exemplary embodiment, partial section 46 is integrally fitted with nozzle body 2 by a completely circumferential welded seam 44, for example. Partial section 46 is situated downstream from seal 37 in this exemplary embodiment. Welded seam 44 joins seal 37 to nozzle body 2 in a hermetically sealing manner. Welded seam 44 may also be made up of at least one welding point.

In the installed state, permanently elastic first section 38 is prestressed with respect to the wall of valve mount opening 48, which extends parallel to center axis 40 at this point.

The discharge-remote end of seal 37 extends at a right angle to center axis 40 in an outward direction and rests on a shoulder 49 formed in valve mount opening 48, which reduces the diameter of valve mount opening 48 in the spray-discharge direction. Between first section 38 and the discharge-side end, seal 37 partially rests against nozzle body 2 in its axial extension.

Figure 3:
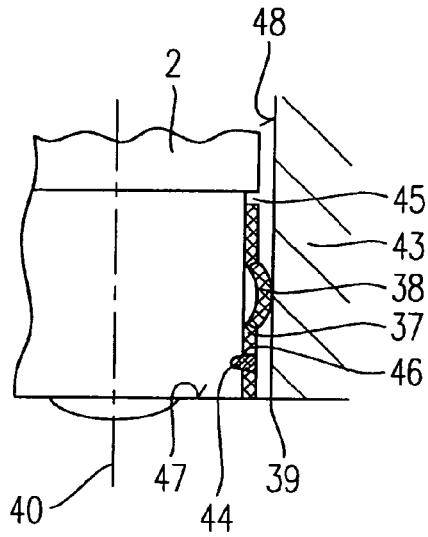
FIG. 3 shows a schematic section through a second exemplary embodiment of a fuel injector according to the present invention, in the discharge-side region.

The second exemplary embodiment, which is shown in FIG. 3 and is similar to the first exemplary embodiment, has a reduced-diameter region 45, which has a uniform diameter up to step 47. The height of seal 37 is slightly smaller than that of reduced-diameter region 45. The diameters of seal 37 at the discharge-remote end and at the discharge-side end are identical. First section 38 is situated at the mid-level of seal 37.

Figure 4:
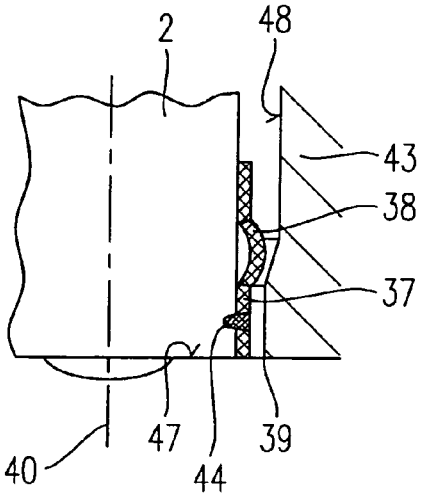
FIG. 4 shows a schematic section through a third exemplary embodiment of a fuel injector according to the present invention, in the discharge-side region.

The third exemplary embodiment, which is similar to the second exemplary embodiment and is shown in FIG. 4, has no reduced-diameter region in the discharge-side region. On the discharge side and on the discharge-remote side of first section 38, seal 37 rests sealingly against nozzle body 2, which has a cylindrical shape on the discharge side.

First section 38 rests on a first bearing surface 41, which tapers and reduces the diameter of valve mount opening 48. Fuel injector 1 is prestressed in the discharge direction, so that seal 37, in cooperation with permanently elastic first section 38, is prestressed with respect to valve mount opening opening 48 in the radial and axial direction.

Figure 5:
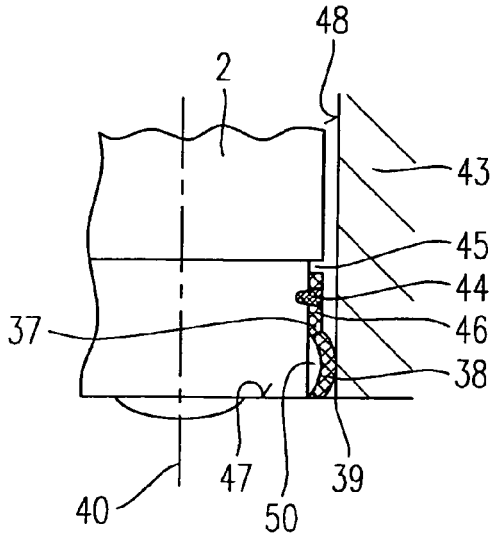
FIG. 5 shows a schematic section through a fourth exemplary embodiment of a fuel injector according to the present invention, in the discharge-side region.

FIG. 5 shows a schematic section through a fourth exemplary embodiment of a fuel injector 1 configured according to the present invention, in the discharge-side region. In this exemplary embodiment, first section 38, which is bent outwardly in the form of a partial circle, is situated on the discharge side of partial section 46. The inner side of first section 38, bent outwardly in the form of a partial circle in cross-sectional profile, rests on a corresponding support section 50 of nozzle body 2, which is likewise bent in an outward direction in the form a partial circle. Support section 50 and first section 38 end on the discharge side at the level of step 47 or transition region 39.

FIG. 6A shows a schematic section through a fifth and sixth exemplary embodiment of a fuel injector 1 configured according to the present invention, in the discharge-side region. The fifth exemplary embodiment is shown on the right and the sixth exemplary embodiment is shown on the left.

Partial section 46 where seal 37 is integrally fitted with nozzle body 2 in the fifth exemplary embodiment, is situated a short distance before the discharge-remote end of seal 37, which rests against nozzle body 2.

In reduced-diameter region 45, seal 37 extends in the discharge direction from partial section 46 to step 47, resting against nozzle body 2. At the level of step 47, seal 37 extends at a right angle, radially in an outward direction, and shortly thereafter goes over into first section 38 such that it extends in parallel and counter to the spray-off direction, first section 38 ending just before the level of partial section 46. Seal 37 thus has a U-shape in cross-sectional profile in the discharge-side region, the bottom of the U-shape lying at the same level as step 47.

FIG. 6C shows the form of the discharge-side region of seal 37 in the uninstalled state. First section 38 extends in a straight manner; from the bottom of the U-shape it is elastic, slightly tilted outwardly at 30°, for instance, based on the installation position in FIG. 6A.

In the sixth exemplary embodiment, the cross-sectional profile of seal 37 in the installation position is similar to that in the fifth exemplary embodiment. However, it is rotated at 180° in cross section. The bottom of the U-shape lies directly at the edge formed by reduced-diameter region 45. Seal 37 is fitted in partial section 46 lying on the discharge side, by welding seam 44.

FIG. 6B shows the form of the discharge-side region of seal 37 in the uninstalled state. First section 38 extends outwardly in the form of a circle segment and has an elastic design.

The seventh exemplary embodiment of fuel injector 1 according to the present invention, which is schematically shown in FIG. 7, has a configuration that is similar to that of the first exemplary embodiment of FIG. 2. However, on the discharge-remote side, seal 37 ends at nozzle body 2; the cross-sectional profile of first section 38 has a wave-shaped design, and partial section 46 situated on the discharge side of first section 38 is joined to nozzle body 2 with form-locking by a connection section 51. Toroidal connection section 51 of partial section 46 narrows the diameter of partial section 46 and engages with a correspondingly formed recess 52 of nozzle body 2 in the process. The connection may be designed to be releasable or non-releasable.

Figure 8:
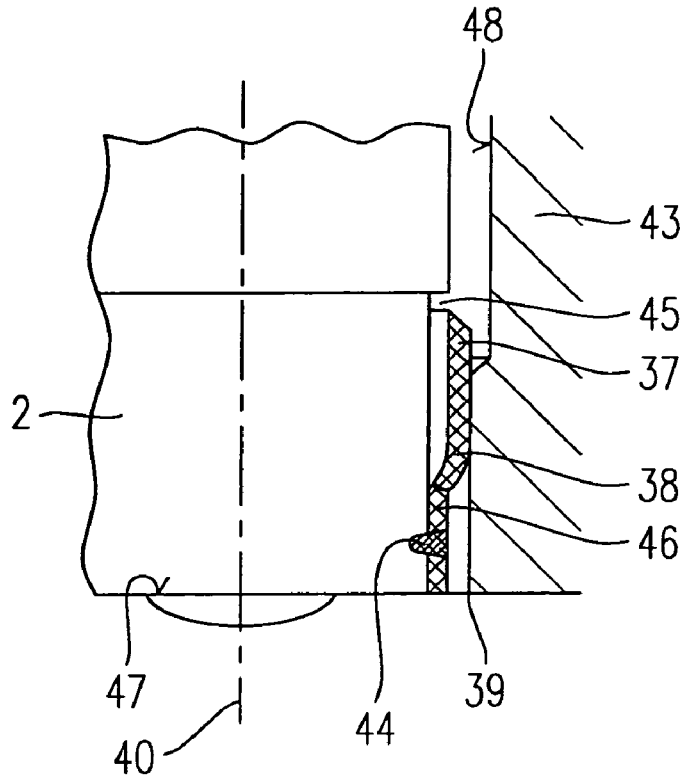
FIG. 8 shows a schematic section through an eighth exemplary embodiment of a fuel injector according to the present invention, in the discharge-side region.

FIG. 8 shows a schematic section through an eighth exemplary embodiment of a fuel injector 1 configured according to the present invention, in the discharge-side region. First section 38 extends outwardly in the form of a partial circle and widens the diameter of seal 37 counter to the discharge direction to a diameter that remains unchanged up to the discharge-remote end of seal 37. The discharge-remote end of seal 37 is beveled on the outside.

Figure 9:
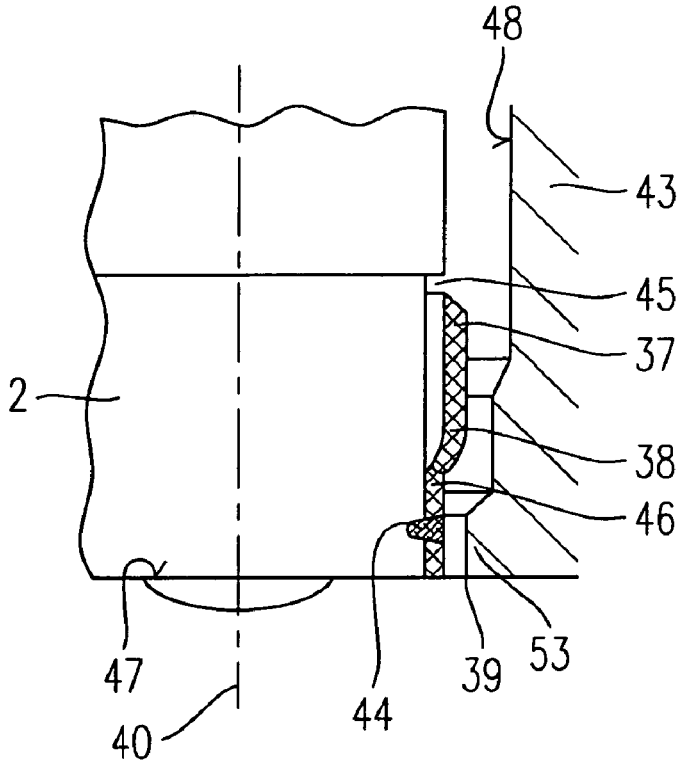
FIG. 9 shows a schematic section through a ninth exemplary embodiment of a fuel injector according to the present invention, in the discharge-side region.

FIG. 9 shows a schematic section through a ninth exemplary embodiment of a fuel injector 1 configured according to the present invention, in the discharge-side region. Both first section 38, which has a larger diameter than partial section 46, and partial section 46 sealingly rest on the wall of valve mount opening opening 48. Partial section 46, situated on the discharge side of first section 38, sealingly rests on a shoulder 53, which reduces the diameter of the discharge-side end of valve mount opening opening 48.

The present invention is not limited to the illustrated exemplary embodiments. The features of the exemplary embodiments may be combined with each other as desired.

What is claimed is:

1. A fuel injector, comprising:

a valve-seat surface;

an actuator that cooperates with the valve-seat surface to form a sealing seat;

a valve-closure member able to be actuated by the actuator;

a structure including a spray-discharge orifice; and a seal for sealing the fuel injector from a valve mount opening of a cylinder head, wherein:

the seal radially surrounds a region of a discharge-side end of the fuel injector, at least a first section of the seal rests against the valve mount opening in a sealing manner, via at least an axial partial section that extends only across a portion of the axial length of the seal, the seal is fitted in the region of the discharge-side end of the fuel injector in integral fashion, by at least one of a form-fit and a force-locking, the first section is prestressed by an initial stress with respect to the wall of the valve mount opening, and the first section projects outwardly with respect to parts of the seal immediately adjoining the first section, the first section further being permanently elastic, whereby at least a portion of the initial stress is generated.

2. The fuel injector as recited in claim 1, wherein the seal is fitted by at least one of:

one of welding and laser welding, and one of tamping and pressing.

3. The fuel injector as recited in claim 1, wherein the seal made of metal including at least one of deformable steel, V2A steel, a copper alloy, and a brass alloy.

4. The fuel injector as recited in claim 1, wherein at least a portion of the seal has the form of a sleeve.

5. The fuel injector as recited in claim 1, wherein the seal is at least partially produced by a reforming operation corresponding to one of deep-drawing and crimping.

6. The fuel injector as recited in claim 1, wherein the first section projects at least partially toward an outside compared to adjoining parts of the seal.

7. The fuel injector as recited in claim 1, wherein the first section is wave-shaped in cross-sectional profile and sealingly rests against the valve mount opening at a plurality of points.

8. The fuel injector as recited in claim 1, wherein the first section at least one of:

is formed as a partial circle in cross-sectional profile, and widens a diameter of the seal toward an outside in the form of a partial circle.

9. The fuel injector as recited in claim 1,wherein:

the seal has an at least partially U-shaped cross-sectional profile, and an outer side is formed by the first section, and an inner side is formed at least partially by the partial section.

10. The fuel injector as recited in claim 9, wherein a bottom of the U-shaped section is situated one of at a level of a step and at a level of a discharge-remote end of a recessed-diameter region.

11. The fuel injector as recited in claim 1, wherein:

the seal extends between a discharge-side region of the fuel injector and the valve mount opening, axially up to a transition region where the valve mount opening goes over into a combustion chamber.

12. The fuel injector as recited in claim 1, wherein the first section rests at least partially in sealing fashion on a tapering first bearing surface, the first bearing surface reducing a diameter of the valve mount opening.

13. The fuel injector as recited in claim 1, wherein the seal is indirectly prestressed with respect to at least a first bearing surface via other components of the fuel injector.

14. The fuel injector as recited in claim 1, wherein the seal is at least partially coated.

15. The fuel injector as recited in claim 1, wherein the seal is beveled on an outside at least at one of its ends.

* * * * *